United States Patent [19]

Garbowicz et al.

[11] Patent Number: 5,070,279

[45] Date of Patent: Dec. 3, 1991

[54] LAMP IGNITOR WITH AUTOMATIC SHUT-OFF FEATURE

[75] Inventors: Glenn D. Garbowicz, Rosemont; Seymour Perkins, III, Hinsdale, both of Ill.

[73] Assignee: North American Philips Corporation, New York, N.Y.

[21] Appl. No.: 557,890

[22] Filed: Jul. 25, 1990

[51] Int. Cl.[5] ..... H05B 41/14

[52] U.S. Cl. ..... 315/289; 315/119; 315/290; 315/360

[58] Field of Search ..... 315/289, 290, DIG. 2, 315/DIG. 7, DIG. 5, 360, 119

[56] References Cited

U.S. PATENT DOCUMENTS

| | | | |
|---|---|---|---|
| 4,107,579 | 8/1978 | Bodine, Jr. et al. | 315/DIG. 7 |
| 4,207,500 | 6/1980 | Duve et al. | 315/289 |
| 4,695,771 | 9/1987 | Hallay | 315/290 |
| 4,763,044 | 8/1988 | Nuckolls et al. | 315/289 |
| 4,896,077 | 6/1990 | Dodd et al. | 315/289 |

*Primary Examiner*—Eugene R. LaRoche
*Assistant Examiner*—Son Dinh

[57] ABSTRACT

An ignitor circuit for a discharge lamp is controlled by a timer to shut-off ignition pulses after a predetermined time if the lamp does not ignite. The timer is controlled by the application of power to the input line. Means in the lamp housing allow the timer to be manually reset during a hot relamping operation.

19 Claims, 3 Drawing Sheets

LAMP IGNITOR WITH AUTOMATIC SHUT-OFF FEATURE

The invention relates to auxiliary equipment for operating gas discharge lamps. More particularly, the invention relates to a timer control circuit for operating a lamp ignitor in conjunction with a discharge lamp ballast.

BACKGROUND OF THE INVENTION

Pulsed ignition circuits are commonly used for starting many discharge lamps. This circuit can be an ignitor which provides sufficient energy in a voltage pulse which is applied to lamp electrodes to break down the gasses in the lamp arc tube allowing enough current to flow in order to start the lamp U.S. Pat. No. 4,695,771 describes a typical, prior art ignitor circuit which is useful with both autotransformer and choke-type magnetic ballast.

Most prior art ignitor circuits operate continuously, whenever power is applied to the lamp fixture, to apply at least one ignition pulse per half cycle of the AC line voltage until the lamp lights. Good lamps start virtually immediately; however, burned-out lamps will not start and the ignitor will thus pulse continuously. Some quarters of the lighting users and industry have expressed concern that stress imposed by a continuous train of ignition pulses could shorten the life of insulation and/or electronic components associated with the ballast and lighting fixture.

In addition, at their end-of-life, many high intensity discharge lamps go through an on and off cycling phase that may last several weeks. In this phase, the aged lamp turns itself off due to the arc voltage increase that has taken place over time. Since the power to the ballast is still on, the ignitor immediately starts pulsing. In a minute to several minutes, the lamp cools down enough to be restruck by the ignitor.

This cycling can be particularly annoying and/or disturbing to anyone who must be in the presence of such lamps. Also, by the time discharge lamps start their cycling phase, their performance characteristics such as lumen efficacy and/or color have deteriorated significantly. Allowing cycling lamps to remain active means that the user of those lamps is not benefiting from the lighting installation in the way it was intended. He will be experiencing distinctly lower light levels, and/or color distortion as he tries to perform his tasks under such lamps.

Lamp cycling can also be particularly disadvantageous in applications such as highway lighting since service crews which happen down the road during the period when the lamp is in the illuminated phase of the cycle will fail to detect the need to change a lamp.

U.S. Pat. No. 4,665,346 describes a lamp auxiliary circuit with a starter circuit which is controlled by a timer, so that it only operates for a predetermined period after power is applied to the circuit. This patent further describes logic circuits which are designed to prevent on-off cycling of high intensity discharge lamps as arc voltage increases at end-of-life.

In many discharge lamp installations, maintenance crews re-lamp fixtures while they are "hot"; that is lamps are replaced without first removing line voltage from the fixture. If a lamp ignitor circuit is controlled by a timer so that it will not operate except for a specified period after power is applied, the ignitor circuit will not immediately activate the new lamps after hot installation, in which case their operation cannot be verified by maintenance personnel.

SUMMARY OF THE INVENTION

In accordance with the invention, a timer circuit is utilized to control the duration of operation of an ignitor circuit for a discharge lamp. The output of the ignitor circuit may be connected across a segment of a reactor or autotransformer ballast while the input to the timer circuit is powered directly from the primary or secondary ballast coil. The timer is set to activate the ignitor for a short, predetermined period after power is first applied to the fixture circuit and to thereafter disable operation of the ignitor until line power is removed and then reapplied to the fixture circuit. As in prior art timer circuits, the timer reduces possible voltage stress on the ballast insulation and electrical and electronic components which might otherwise occur with a continuously operating ignitor. Moreover, since the improved timer configuration of the present invention is not reset when rising arc voltage extinguishes a lamp, cycling, of for example metal halide lamps, is precluded and maintenance of large lighting installations is thus facilitated on a more timely basis.

In accordance with the present invention, means are provided for resetting the timer when a new lamp is inserted into a fixture so that its operation may be immediately verified.

In one embodiment of the invention, the timer is reset via a quick disconnect fitting. In alternate embodiments, the timer may be manually reset with a switch, such as a push button.

IN THE DRAWINGS

The invention may be understood with reference to drawings in which.

DESCRIPTION OF PREFERRED EMBODIMENTS

Figure 1:
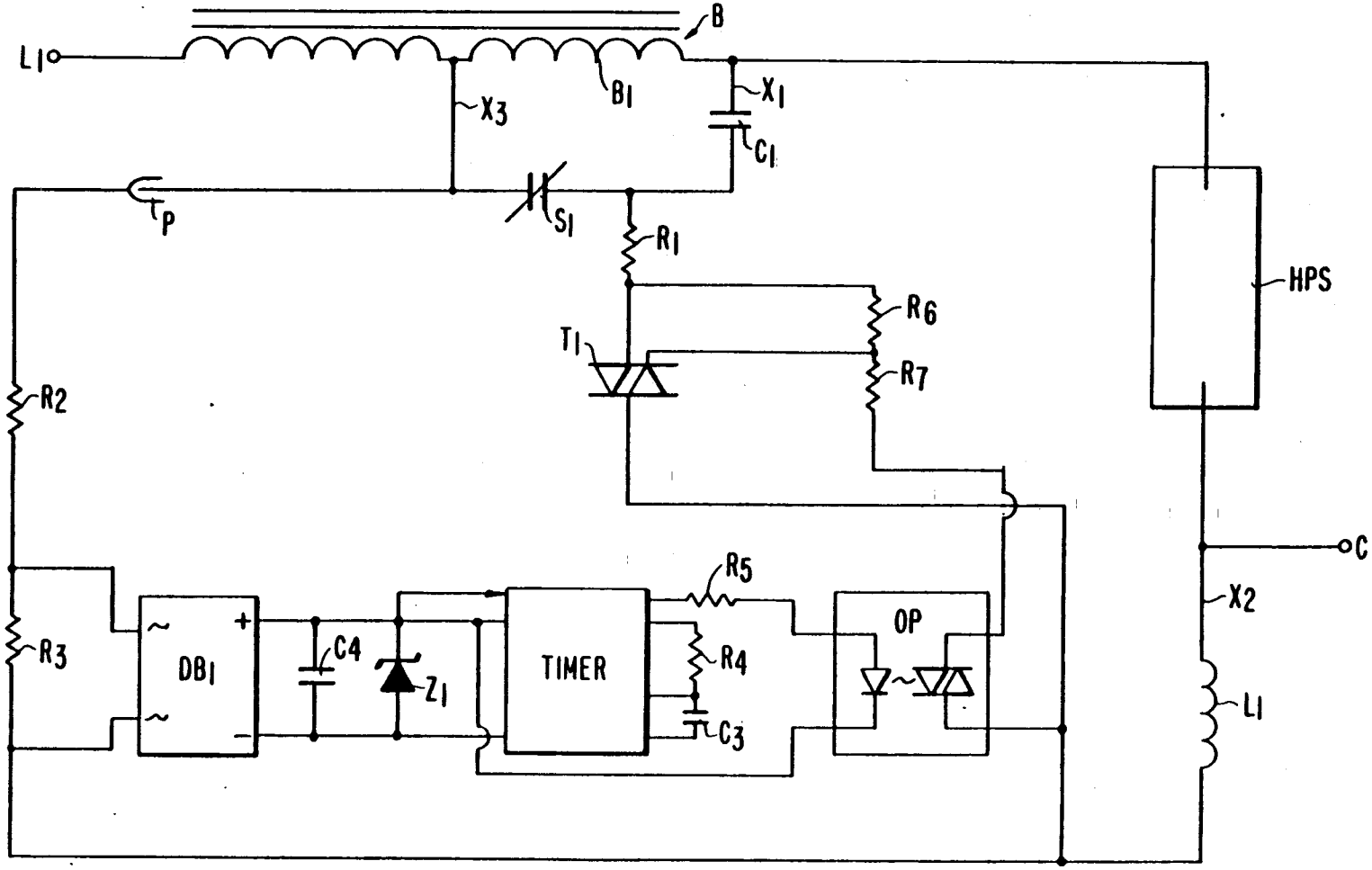
FIG. 1 is an auxiliary circuit for operating a high pressure sodium lamp.

FIG. 1 is an auxiliary circuit which provides an ignition pulse, on the order of 2.5–4 kilovolts, to a 100 volt high pressure sodium lamp HPS. AC line input power is applied to the fixture across terminals L and C. An AC voltage, which may be sinusoidal or somewhat distorted depending on the ballast type, appears at tap terminal X3 of magnetic ballast B. Resistors R2 and R3 act as a voltage divider so that a small part of the voltage at terminal X3 appears across the input of bridge rectifier DB1. The output of the bridge rectifier is smoothed via capacitor C4. Zener diode Z1 provides overvoltage protection. The filtered output of the bridge is applied both as a power supply and an input to a timer DL which may, for example, be a type LM 2905 integrated circuit. The timer output is applied to the input of an opto-isolator OP which causes a light-activated bi-lateral switch at the output of the opto-isolator to close. Output voltage from the opto-isolator OP is applied via resistors R6 and R7 to the gate of a triac T1 when the opto-isolator switch closes. When the triac closes, the ignitor segment of the circuit can function and an AC voltage difference present between ballast terminal X1 and line terminal C causes capacitor C1 to charge through resistor R1, triac T1, and inductor L1. The capacitor voltage increases to the point where sidac S1 closes and rapidly discharges the capacitor C1 through ballast coil segment B1. By transformer action the voltage pulse from capacitor C1 is thus stepped up to provide the ignition pulse across the high pressure sodium lamp.

Choke L1 prevents pulses from feeding back through the power supply and timing network. The timer delay is set by the network R4 and C3. When the delay expires, the input to the opto-isolator is switched off, deactivating the triac and turning off the ignitor. The ignitor is normally reset when line voltage input at terminals L and C is removed and then reapplied.

In a preferred embodiment of the circuit, timer DL has a delay of approximately two and one half minutes and circuit components have the following values:

L1—30 mh;
Z1—33V;
R1—6K;
R2—6.8K;
R3—620;
R4—3.6M;
R5—180;
R6—27K;
R7—100;
C1—0.15 μf;
C3—47μf;
C4—10μf;
S1—240V.

In order to facilitate resetting the timer during a hot re-lamping operation, a quick disconnect terminal P may be provided in series with resistor R2. Alternatively, the quick disconnect terminal P may be replaced by a normally closed switch. The switch may be a push-button on or within the lighting fixture.

Figure 2:
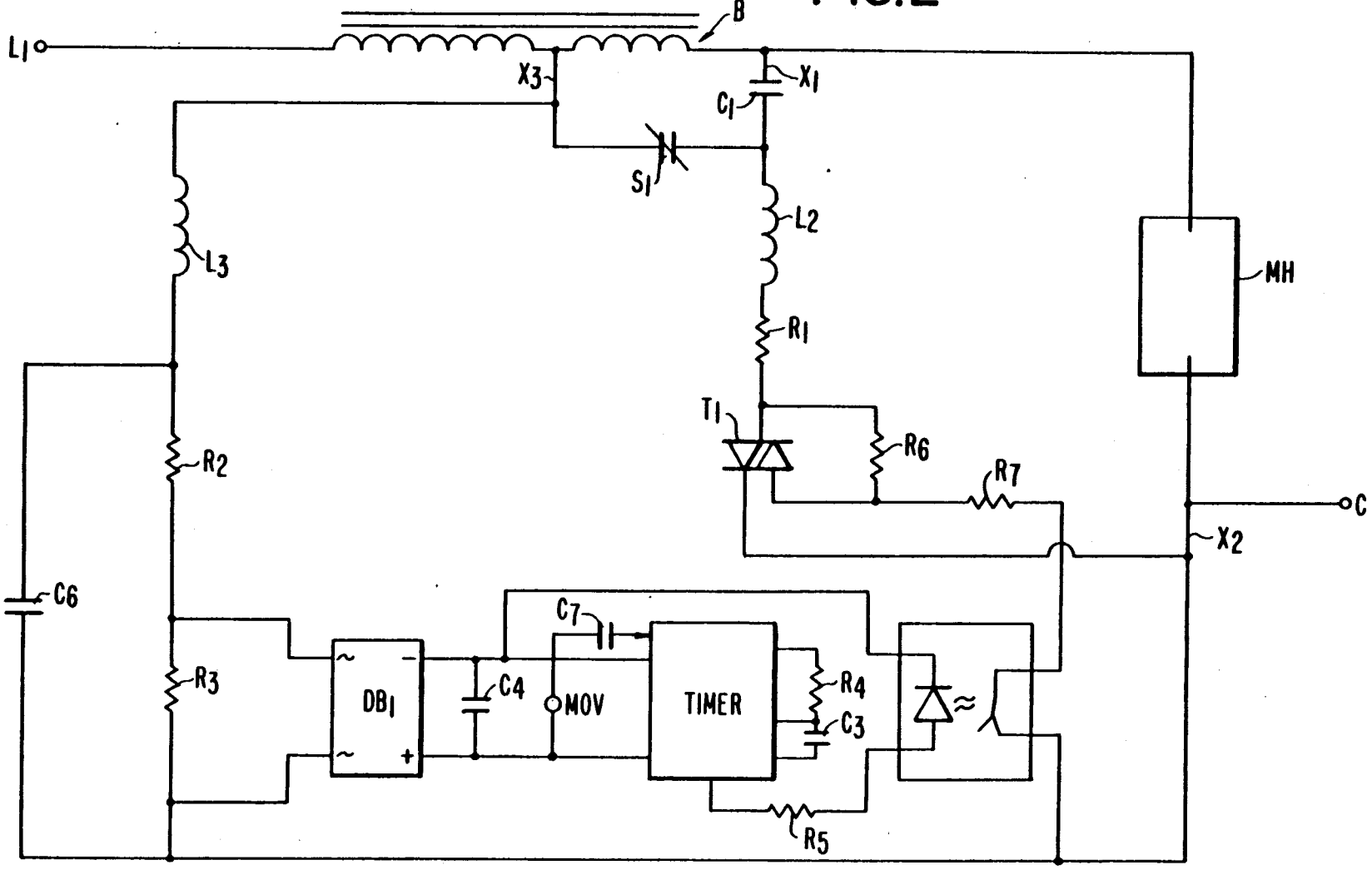
FIG. 2 is an auxiliary circuit for operating a metal halide lamp.

FIG. 2 is an alternate circuit for operating an metal halide lamp MH which may require a starting pulse on the order of 4–6 kilovolts. The components in this circuit correspond to similarly identified components in FIG. 1 and, except as described below, serve the same purpose. The triac T1 is activated by the opto-isolator OP through resistor network R6 and R7. Chokes L2 and L3 together with capacitor C6 isolate the starting pulse from the power supply and timer circuits. A timer reset function may not be required for re-lamping since many metal halide fixtures are equipped with shut-off switches, for ultraviolet protection, which remove line voltage from the ballast whenever the fixture is opened.

Figure 4:
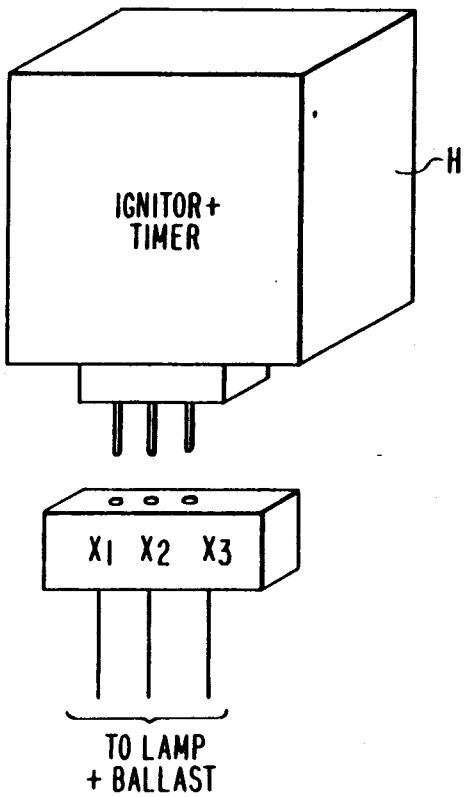
FIGS. 3 and 4 illustrate means for resetting the timer after hot relamping.
Figure 3:
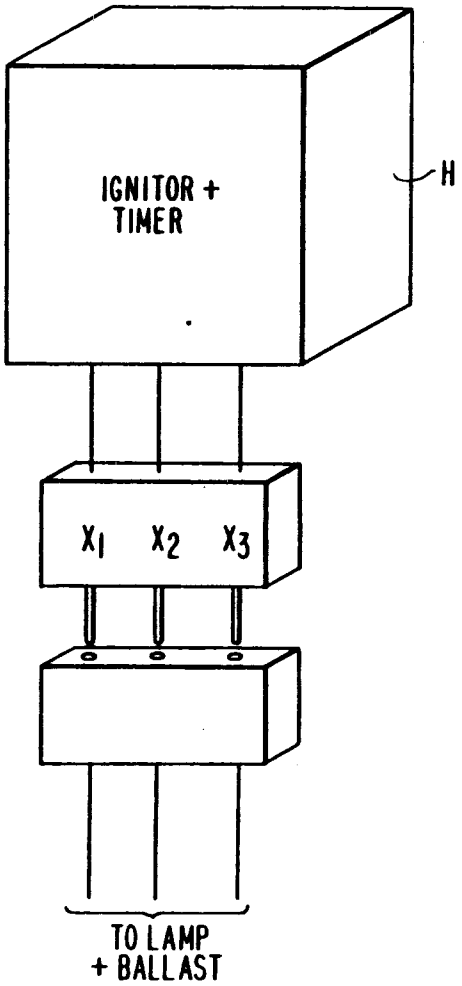

In a preferred embodiment of the circuit of FIG. 2, the timer DL has a delay of approximately 12 to 15 minutes and the component values are:

R1—4K;
R2—6.8K;
R3—820;
R4—15M;
R5—180;
R6—36k;
R7—100;
C1—0.27μf;
C3—47μf;
C4—10μf;
C6—0.33μf;
C7—0.1μf;
S1—220V;
MOV—56V;
L2—60MH;
L3—60MH;

FIGS. 3 and 4 illustrate a system for resetting the timer after relamping a "hot" fixture, for example, in a roadway lighting application. In FIG. 3, the ignitor leads $X_1$, $X_2$, and $X_3$ are routed through a three pin connector within the lamp housing which may be opened and reconnected by maintenance personnel after relamping. In FIG. 4 the connector is fixed to a side of the ignitor circuit housing H. In both cases the male connector is attached to the ignitor leads to reduce shock hazard. The connector has three pins connected, respectively to wires from the ballast tap $X_3$ and the lamp electrodes $X_1$ and $X_2$.

Although the circuit has been described in terms of preferred embodiments, it will be apparent to those skilled in the art that modifications are possible to permit operation of other types of electric discharge lamps. Likewise, although the preferred embodiments have been illustrated with reactor ballasts, the circuit is also directly applicable to autotransformer and isolated transformer ballasts as well as solid state ballasts. Furthermore, the ignitor circuit could also be used with those fluorescent lamps which require an ignitor to start the lamp in cold weather.

We claim:

1. Auxiliary equipment for operating an electric discharge lamp comprising:
   - a magnetic ballast, having a tapped winding, which is connected in series with the discharge lamp and a source of AC line voltage;
   - ignitor circuit means connected to provide ignition pulses across a tapped portion of said winding whereby high voltage ignition pulses are coupled to the lamp;
   - timer means connected to activate and deactivate the ignitor means so that ignition pulses are only generated during a predetermined time period after a reset signal is applied to an input of said timer means;
   - means for electrically isolating the output of said timer means from said ignitor circuit means;
   - means for applying said reset signal to said input of said timer means upon application of line voltage to said auxiliary equipment; and
   - means for manually resetting the timer means after a hot relamping operation.

2. The equipment of claim 1 wherein said reset signal is provided by the application of electrical power to the timer.

3. The equipment of claim 1 wherein a first end of the tapped winding is functionally connected to a first AC line terminal; a second end of the tapped winding is functionally connected to a first electrode of said discharge lamp; a second terminal of said discharge lamp is connected to a second AC line terminal; and further comprising supply means connected to supply power and said reset signal to said timer means which include a rectifier circuit having inputs respectively connected to receive AC power between said second line terminal and a tap on said winding.

4. The equipment of claim 3 wherein said ignitor means comprise a sidac and a capacitor connected in series from said tap to said second end of said winding.

5. The equipment of claim 1 wherein said means for resetting comprise a quick disconnect terminal pair connected in series between said tap and said supply means.

6. The equipment of claim 1 wherein said means for resetting comprise a normally closed switch connected in series between said tap and said supply means.

7. The equipment of claim 1 wherein said switch is a push button.

8. The equipment of claim 1 wherein said lamp is a high intensity discharge lamp.

9. The equipment of claim 1 wherein said lamp is a fluorescent lamp.

10. The equipment of claim 1 wherein the ballast is a reactor ballast.

11. The equipment of claim 1 wherein the ballast is an autotransformer ballast.

12. Auxiliary equipment operating an electric discharge lamp comprising:

a magnetic ballast, having a tapped winding, which is connected in series with the discharge lamp and a source of AC line voltage;

ignitor circuit means connected to provide ignition pulses across a tapped portion of said winding whereby high voltage ignition pulses are coupled to the lamp;

timer means connected to activate and deactivate the ignitor means so that ignition pulses are only generated during a predetermined time period after a reset signal is applied to an input of said timer means;

means for applying said reset signal to said input of said timer means upon application of line voltage to said auxiliary equipment; and wherein the ignitor circuit means and timer means are contained within a common housing which is separate from the magnetic ballast and wherein the means for resetting comprise a multi-pin connector in wiring which connects the housing to the lamp and ballast.

13. The equipment of claim 12 wherein the connector comprises a first part, having male pins, connected to the housing and a second part, having female receptacles, connected to the lamp and ballast.

14. The equipment of claim 13 wherein a first of the receptacles is connected to a tap of said ballast winding, and second and third of said receptacles are connected to respective electrodes of said lamp.

15. The equipment of claim 12 wherein said connector is affixed to said housing.

16. Auxiliary equipment for operating an electric discharge lamp from an AC power line comprising:

a pulse ignitor circuit connected to ignite said lamp;

timer means which cause said ignitor to operate for a short predetermined period after operating power is applied to said lamp and to thereafter deactivate said ignitor circuit;

means for electrically isolating the output of said timer means from said ignitor circuit means; and means for manually resetting said timer means during a hot relamping operation.

17. The equipment of claim 6 wherein the means for manually resetting comprise a quick-disconnect terminal pair.

18. The equipment of claim 6 wherein the means for resetting comprise a normally-closed switch.

19. The equipment of claim 18 wherein the switch is a push button.

* * * * *